US006935052B2

(12) United States Patent
Sonner et al.

(10) Patent No.: US 6,935,052 B2
(45) Date of Patent: Aug. 30, 2005

(54) DRYER

(75) Inventors: Harald Sonner, Sindelfingen (DE); Achim Vogt, Neustetten (DE)

(73) Assignee: Eisenmann Maschinenbau KG (DE)

( * ) Notice: Subject to any disclaimer, the term of this patent is extended or adjusted under 35 U.S.C. 154(b) by 0 days.

(21) Appl. No.: 10/479,393

(22) PCT Filed: May 6, 2002

(86) PCT No.: PCT/EP02/04936

§ 371 (c)(1),
(2), (4) Date: Jul. 16, 2004

(87) PCT Pub. No.: WO02/097346

PCT Pub. Date: Dec. 5, 2002

(65) Prior Publication Data

US 2004/0237339 A1 Dec. 2, 2004

(30) Foreign Application Priority Data

May 26, 2001 (DE) ..... 101 25 771

(51) Int. Cl.[7] ..... F26B 21/02

(52) U.S. Cl. ..... 34/666; 34/219; 34/227; 34/233

(58) Field of Search ..... 34/666, 267, 270, 34/271, 218, 219, 227, 232, 233, 548, 549, 77, 78, 423

(56) References Cited

U.S. PATENT DOCUMENTS 5,588,830 A 12/1996 Josefsson et al.
5,657,555 A * 8/1997 Milojevic et al. ..... 34/271
5,661,912 A * 9/1997 Bhatnagar et al. ..... 34/666
6,546,647 B2 * 4/2003 Speck ..... 34/666

FOREIGN PATENT DOCUMENTS

| | | | |
|---|---|---|---|
| DE | 198 58 305 | C1 | 4/2000 |
| DE | 199 41 184 | A1 | 3/2001 |
| EP | 0 706 021 | A1 | 8/1996 |
| EP | 1 080 788 | A1 | 3/2001 |
| JP | 611 64 673 | A | 12/1986 |
| JP | 020 90 970 | A | 6/1990 |

* cited by examiner

*Primary Examiner*—Jiping Lu
(74) *Attorney, Agent, or Firm*—Factor & Lake

(57) ABSTRACT

The invention relates to a dryer for objects, in particular for motor vehicle bodies (1). Known dryers comprise a drying tunnel (6), located within an insulated housing (2), a number of nozzles (25) being arranged in the lateral walls (8) of said tunnel. These nozzles are used to direct hot circulatory air against the objects (1). The circulatory air is extracted from the drying tunnel (6) by means of extraction openings (7) below the objects (1) and is supplied to two air chambers (13) located at the sides of the drying tunnel (6). The circulatory air is extracted upwards via said chambers with the help of fans (18). A heat register (26) is located in each of the two air chambers (13) and is aligned in a substantially vertical direction, said registers consisting of a number of intercommunicating pipe sections that are traversed by hot primary air and are surrounded by the circulatory air. The circulatory air that is heated in this manner is supplied to air distribution chambers (24), which are located on the pressure side of the fan (18), are adjacent to the lateral walls (8) of the drying tunnel (6) and which communicate with the internal chamber of the drying tunnel (6) by means of the nozzles (25).

7 Claims, 9 Drawing Sheets

DRYER

Figure 1:
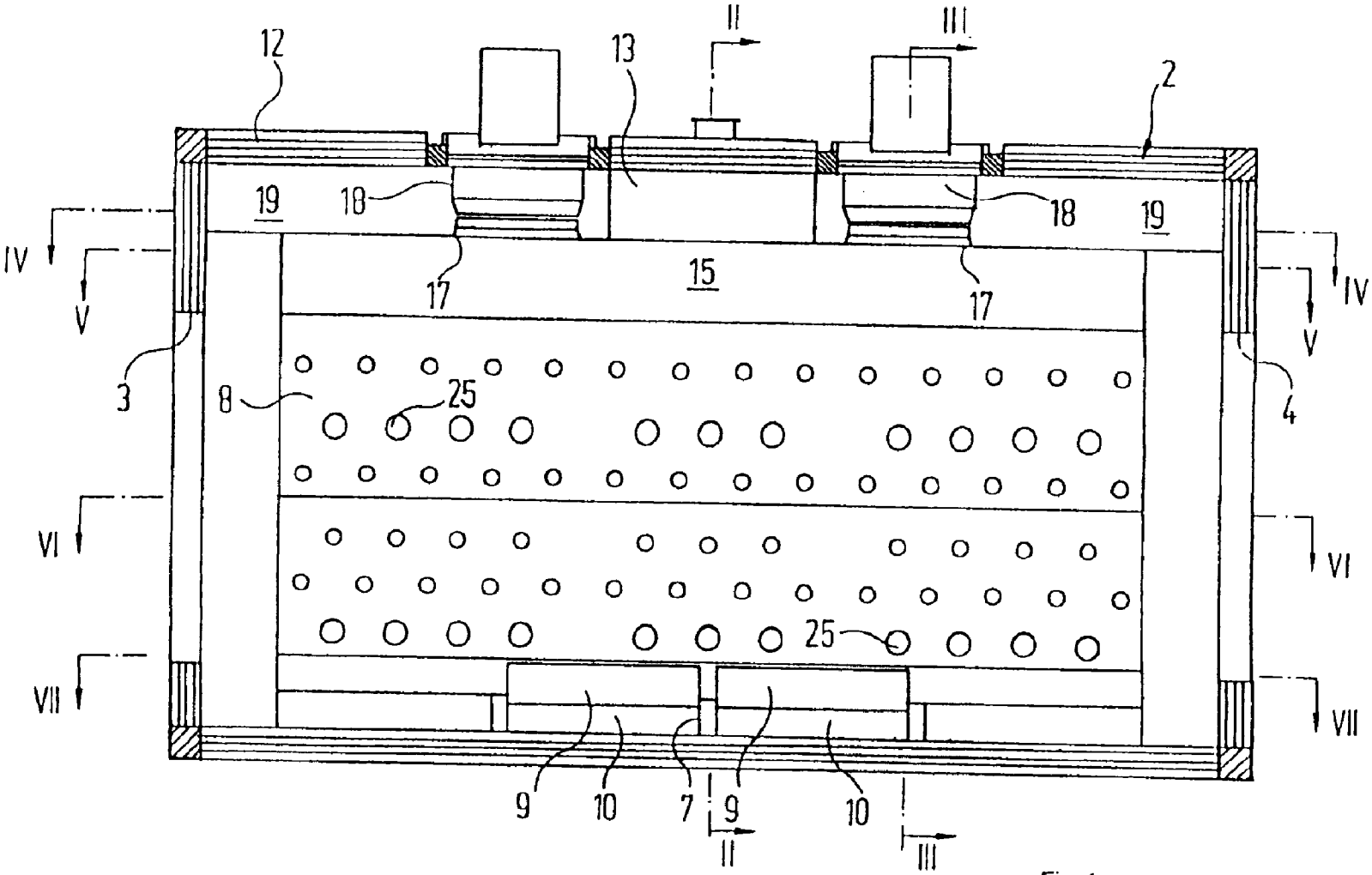

The invention relates to a dryer for objects, in particular for vehicle bodies, with a) an insulated housing;

b) a dryer tunnel arranged within the housing, in the side walls of which a plurality of inlets are arranged, via which hot circulating air can be directed towards the objects;

c) at least one suction-extraction aperture in the region of the dryer tunnel situated below the objects, via which the circulating air emerges from the dryer tunnel;

d) at least one air space arranged to the side of the dryer tunnel, via which the circulating air is drawn upwards with the aid of a blower;

e) at least one air-diffusing space bordering the side wall of the dryer tunnel, which communicates with the pressure side of the blower and from which the circulating air reaches the interior space of the dryer tunnel via the nozzles;

f) a piping system located in the interior space of the housing, through which hot primary gases flow and which is in heat-exchange relationship with the circulating air.

Dryers, in particular those which are intended to be used in paint shops for automobiles, are subject to stringent requirements in two respects: the demand for space and the demand for energy should be as low as possible.

In the introduction to the description of EP 0 706 021 A1, a dryer such as is still frequently encountered in practice today is appraised as state of the art. With this dryer, hot primary gas is generated with the aid of a heater assembly, for example a burner, situated outside the actual dryer housing, and, via a heat-exchanger which itself is likewise situated outside the insulated dryer housing, said primary gas is brought into heat-exchange relationship with the circulating air which is passed through the dryer tunnel and which performs the actual drying action. This structural design entails the twofold disadvantage that the components arranged outside the dryer housing, in particular the various heat-exchangers, take up space which should be available as far as possible for other purposes, and that, furthermore, pipelines are required with which the circulating air is conducted out of the dryer housing and back into the latter and which have to be insulated, in order to avoid losses of heat.

The dryer that is the actual subject-matter of EP 0 706 021 A1 attempts to eliminate these problems by dispensing with heat-exchangers arranged outside the dryer housing. Instead, the flow of hot primary gas which is generated by a central heater assembly is conducted through a double-walled horizontal pipe located in the interior of the dryer housing. Depending on the position of regulating flap valves which are provided intermittently, the hot primary gas within the inner pipe is conducted either through the respective dryer section, and as a result is not available as a source of heat for the circulated air, or through the intermediate space between the inner pipe and the outer pipe which serves as a heat-exchange surface for the air that is circulated in the section in question. This structural design is elaborate and not easy to clean or to maintain.

The object of the present invention is to configure a dryer of the type mentioned in the introduction in such a way that it is inexpensive to produce and easy to maintain.

According to the invention, this object is achieved in that g) the piping system conducting hot primary gases takes the form of a heating unit which comprises a plurality of pipe sections, which communicate with one another and which are flowed around, and is arranged in substantially vertical orientation in the air space which, as a result, is configured as a heating space and has the circulating air flowing vertically upwards through it.

In accordance with the invention, the piping system that conducts the hot primary gas is accordingly not routed over the full length of the dryer tunnel and is not flowed through parallel to the longitudinal direction thereof. Rather, the piping system takes the form of a heating unit which is arranged in vertical orientation in the space that has the circulating air flowing vertically upwards through it on its way to the blower. The heating unit arranged in the heating space promotes the flow of the circulating air vertically upwards there by heat convection. Each heating unit supplies a section of the overall dryer in which the temperature prevailing in the interior space of the dryer tunnel is not to be changed, so that complicated flap-valve mechanisms and control mechanisms, such as are required in the case of a pipeline system extending parallel to the dryer tunnel, according to EP 0 706 021 A1, are not needed. The partitioning into individual sections exhibiting differing temperatures comes about in the present invention through the overall dryer being divided up into a plurality of modules, each of which exhibits the structural design according to the invention, described above, with a vertically orientated heating unit which has primary gas flowing through it.

The heating unit according to the invention is readily accessible, can be cleaned easily, and can be easily exchanged if need be. The exchange can even be performed when the complete plant is operating. In this case the modules connected upstream and downstream are able to compensate temporarily for the lost heating capacity by means of higher individual output, so that emergency operation is possible.

Finally, the heating units that are employed in accordance with the invention do not hinder access to those spaces via which the air filters that are present in the dryer are maintained.

With the dryer according to the invention, the advantage is preserved that the space outside the dryer housing is not taken up by heat-exchangers, and no insulated pipelines leading to said heat-exchangers are required which have to be routed out of the dryer housing. Overall, the dryer according to the invention is very much more economical to produce than that which is described in EP 0 706 021 A1, and it is also easier to control and to maintain. In addition, it is also less susceptible to faults.

The heating space expediently extends only over a part of the length of the dryer tunnel and communicates with suction ducts which in turn extend over the entire length of the dryer tunnel. In this way, the dimensions of the heating unit in the longitudinal direction of the dryer tunnel can be kept comparatively small. The circulating air is firstly "collected" via the suction ducts before it is then conducted upwards in directed manner through the heating space past the heating unit.

In this case a configuration of the dryer is possible in which, viewed in the longitudinal direction of the dryer tunnel, in addition to the heating space at least one air-directing space is provided which is connected via passage apertures to the air-diffusing space bordering the side wall of the dryer tunnel. The heating space and the air-directing space are accordingly situated alongside one another at approximately the same lateral distance from the middle of the dryer tunnel in such a way that no additional space requirement arises in the lateral direction.

In the passage apertures of the air-directing space, filters are expediently installed in which the circulating air is cleansed of extraneous substances once more prior to entering the interior space of the dryer tunnel.

Particularly advantageous is that configuration of the invention in which the upper end of the heating space communicates with a suction space which is arranged immediately above the dryer tunnel and into which the suction aperture of the blower leads. With this routing of the suction space, which, after all, has freshly heated circulating air flowing through it, the upper side of the dryer tunnel is also kept warm, so that a uniform temperature distribution prevails in the interior space thereof.

A pressure space which is connected to the pressure side of the blower and which communicates laterally with the air spaces may extend above the suction space.

Finally, it is expedient if the heating unit is arranged in the heating space in suspended manner.

Figure 2:
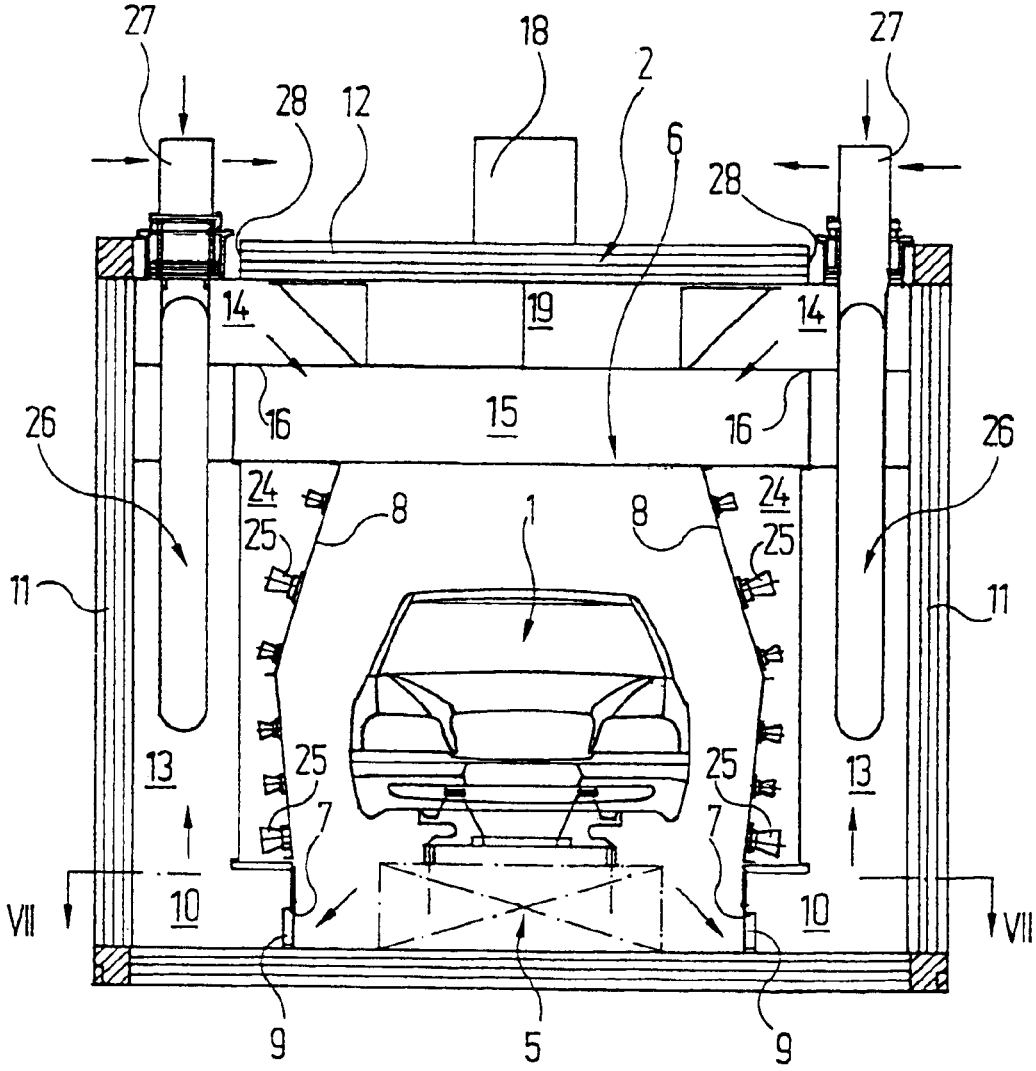
Figure 3:
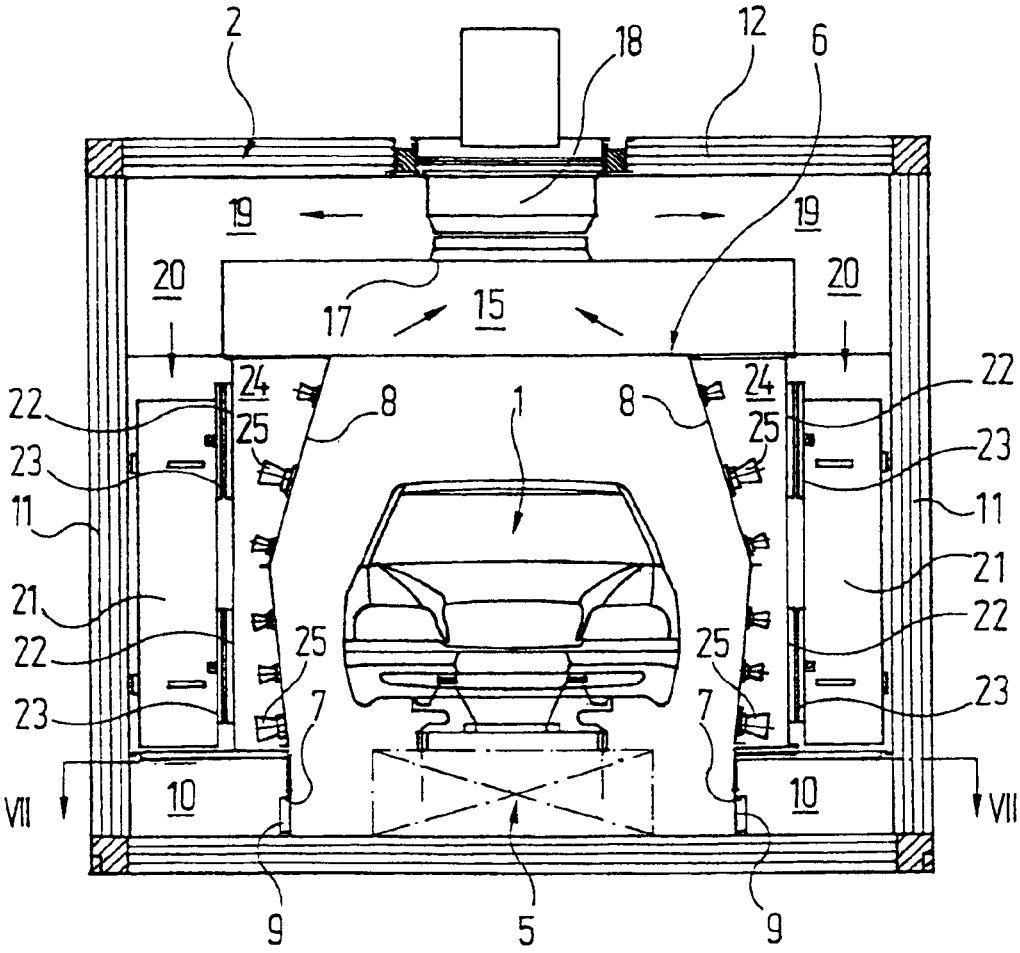
Figure 4:
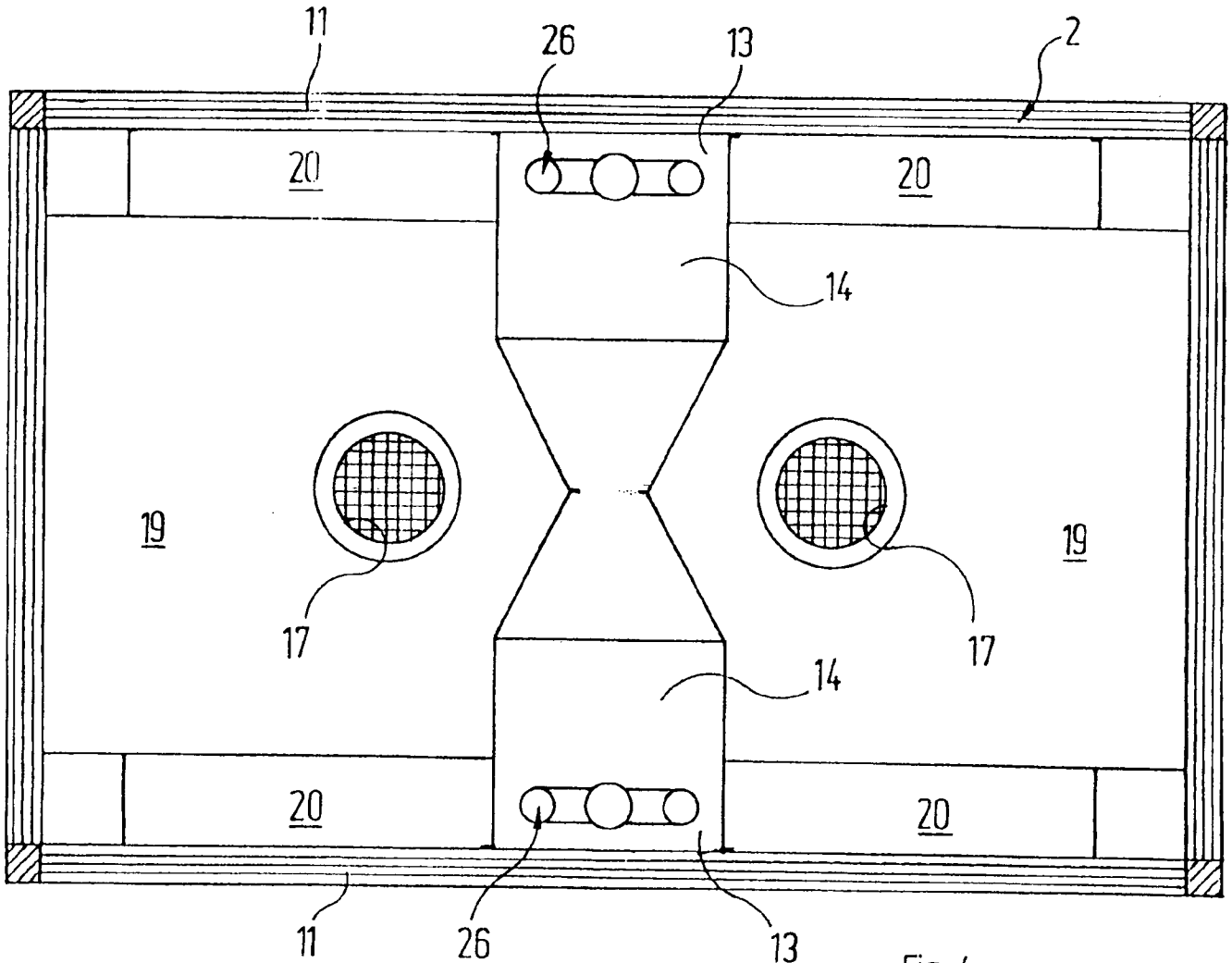
Figure 5:
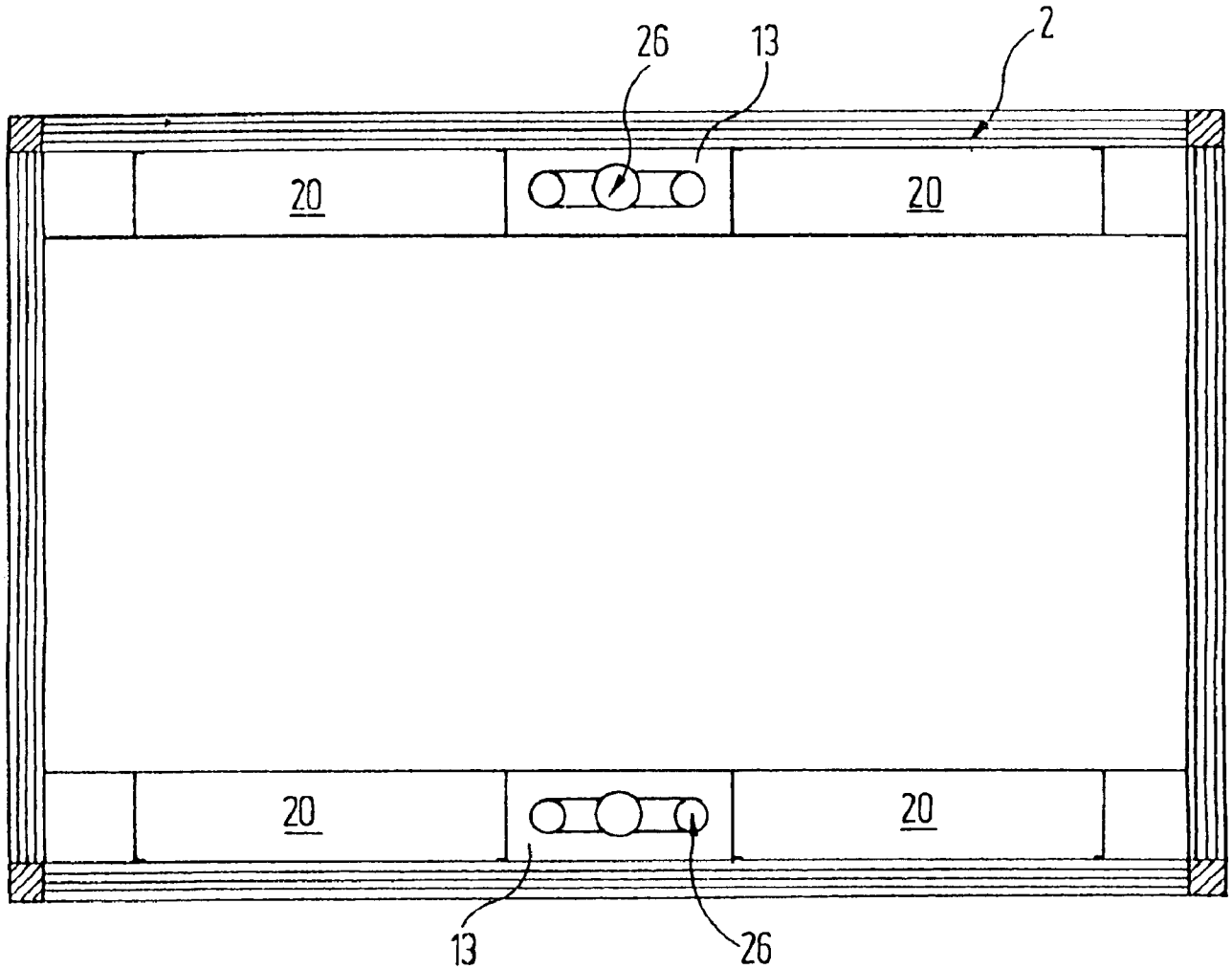
Figure 6:
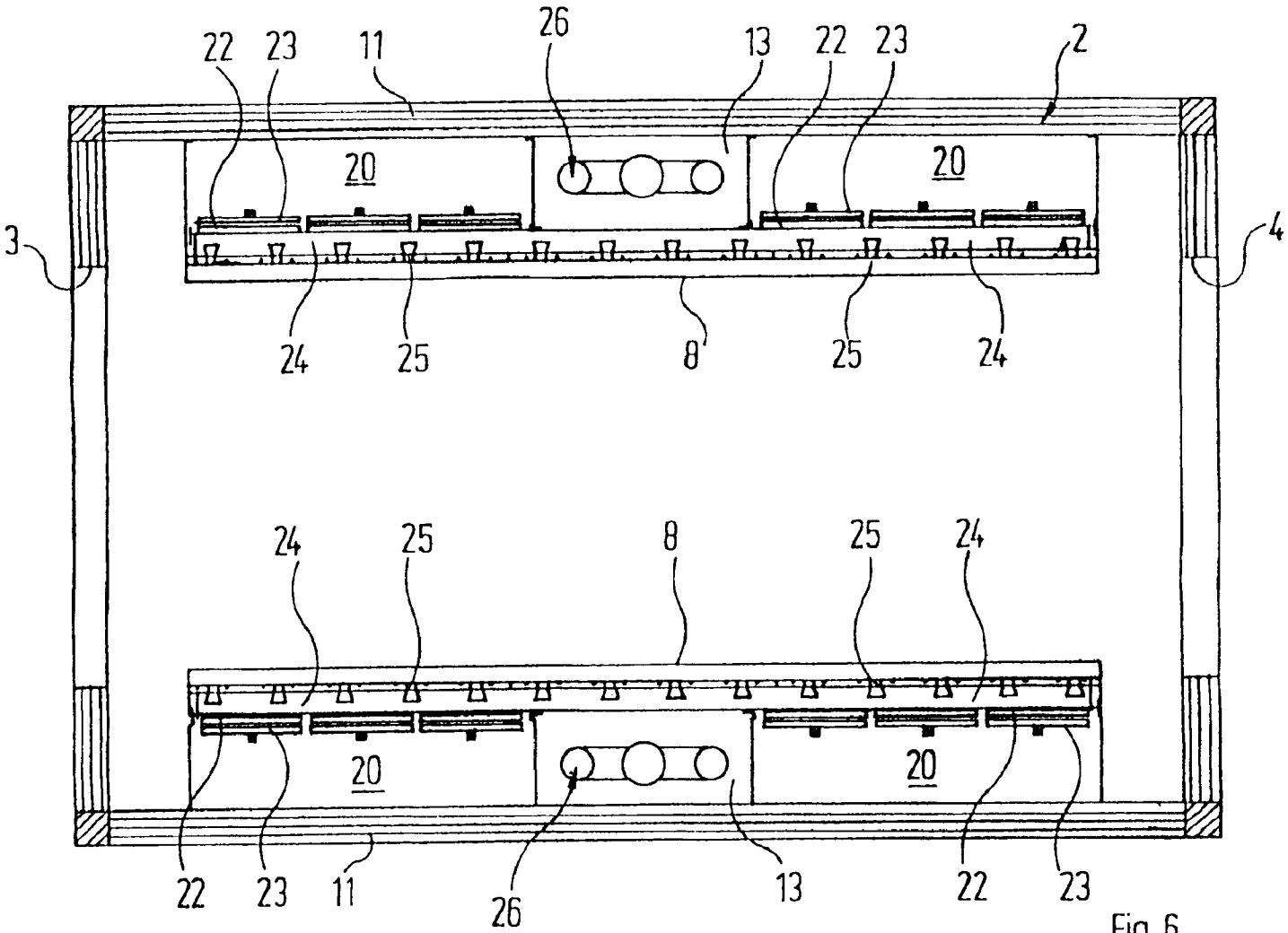
Figure 7:
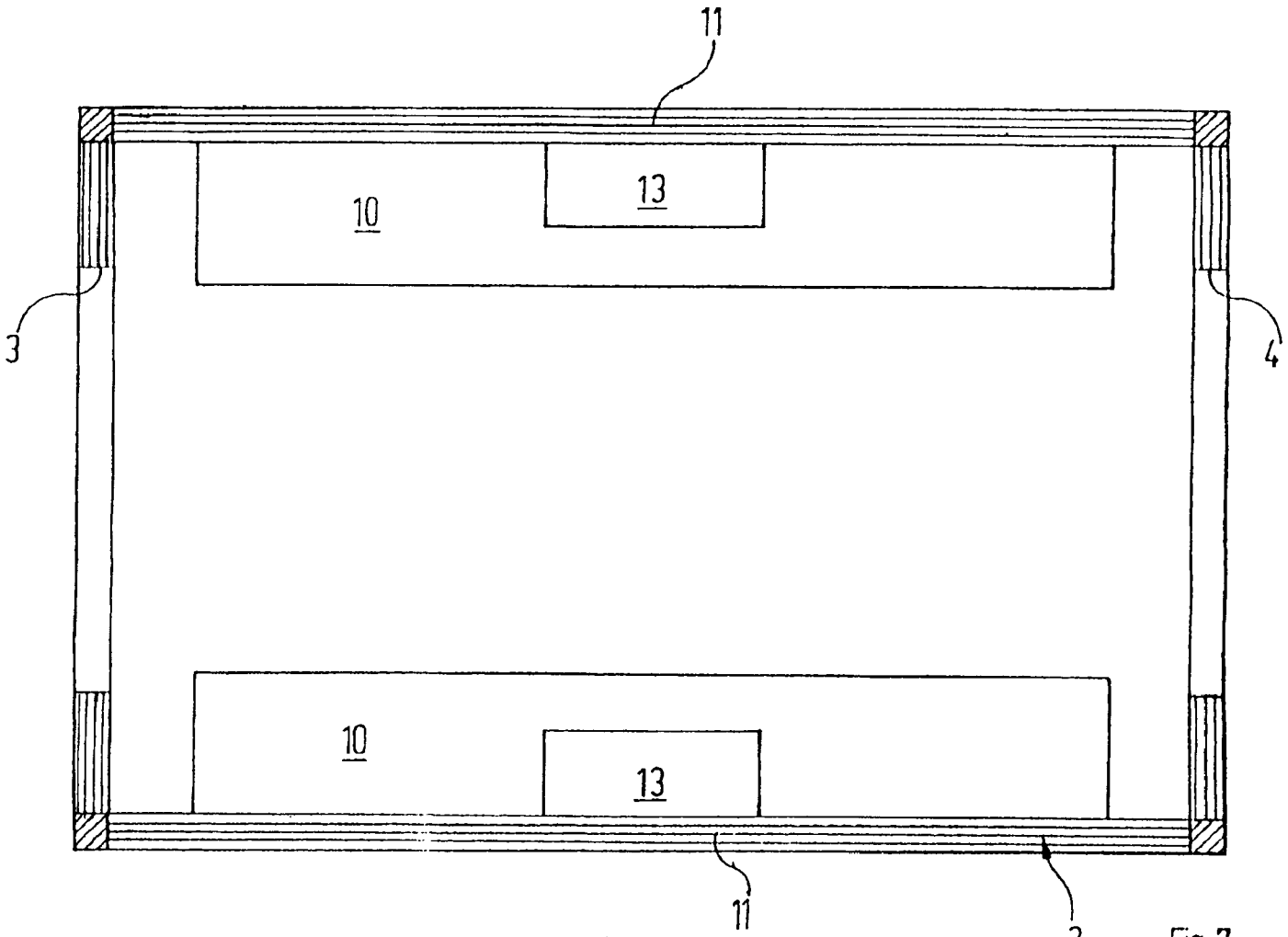
Figure 8:
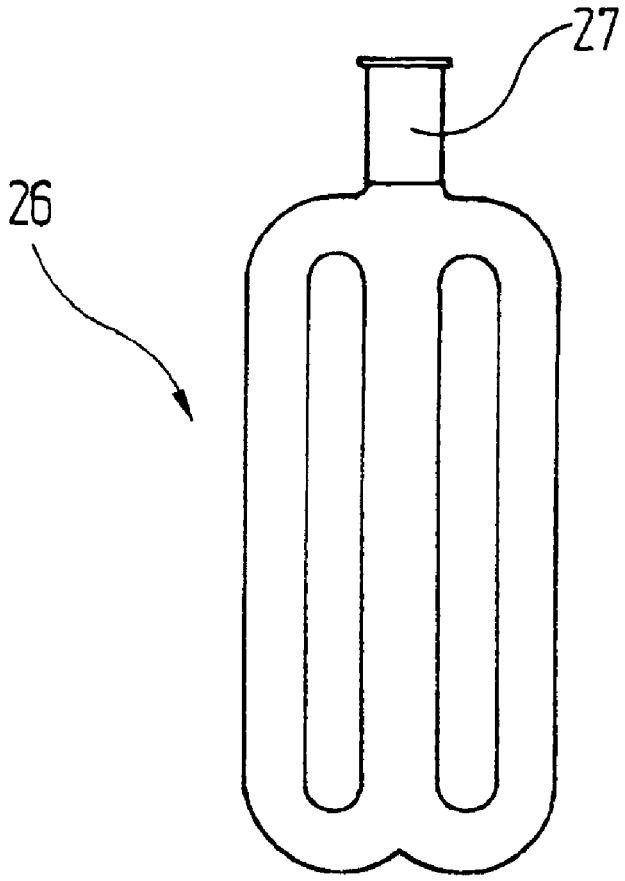
Figure 9:
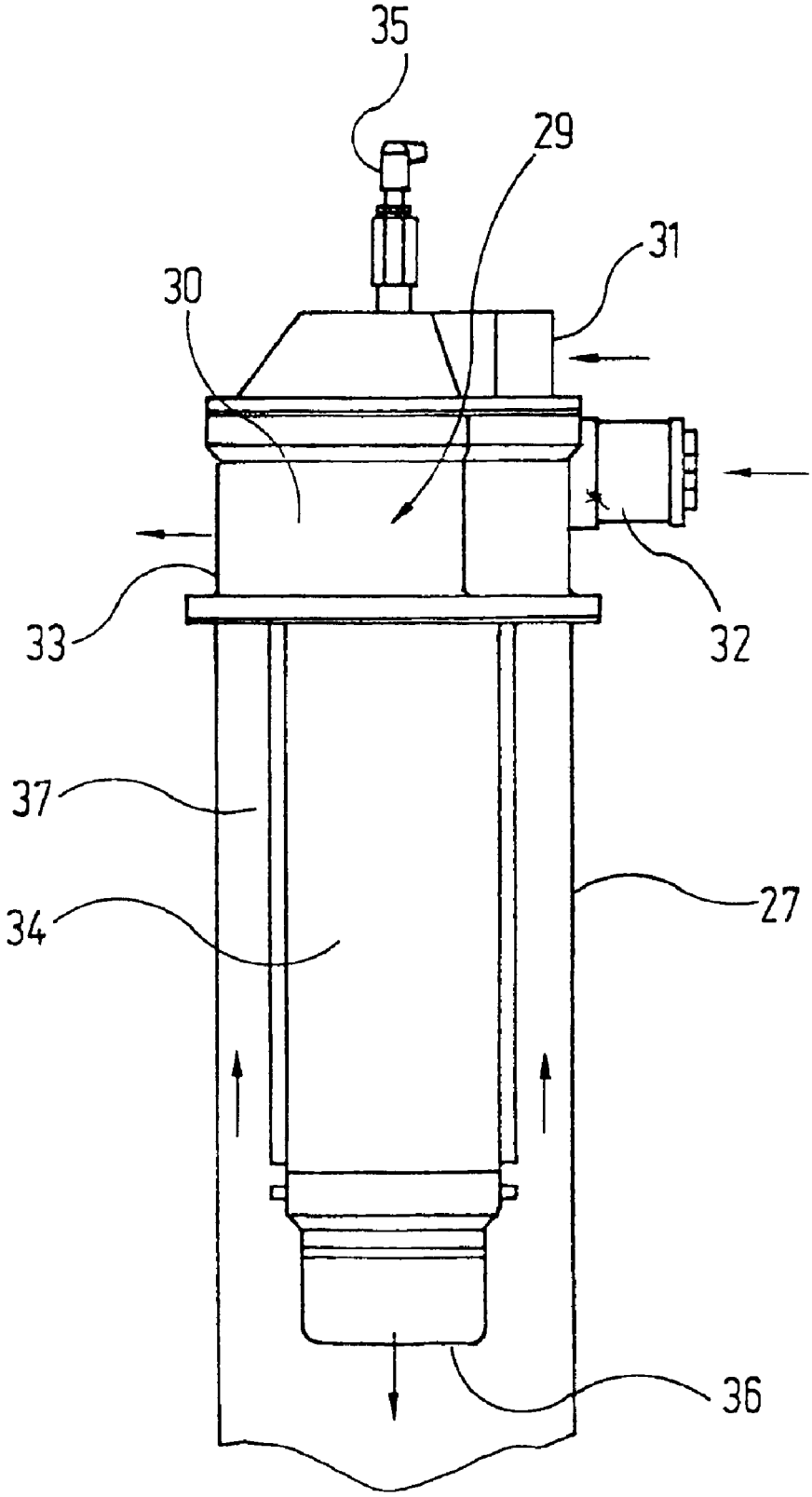

An exemplary embodiment of the invention will be elucidated in more detail in the following with reference to the drawing; shown are:

FIG. 1: a vertical longitudinal section through a dryer module;

FIG. 2: a section through the dryer module according to FIG. 1 along line II—II therein;

FIG. 3: a section through the dryer module according to FIG. 1 along line III—III therein;

FIG. 4: a horizontal section through the dryer module of FIG. 1 along line IV—IV therein;

FIG. 5: a section through the dryer module of FIG. 1 along line V—V therein;

FIG. 6: a section through the dryer module of FIG. 1 along line VI—VI therein;

FIG. 7: a section through the dryer module of FIG. 1 along line VII—VII therein;

FIG. 8: the side view of a heating unit as employed in the dryer module according to FIGS. 1 to 7;

FIG. 9: a section on an enlarged scale through the uppermost region of the heater assembly of FIG. 8, in which the gas routing therein and a high-speed burner can be discerned.

The dryer module that is described in detailed manner in the following serves for drying freshly lacquered vehicle bodies 1, but in its basic conception it may be used for drying arbitrary objects. Ordinarily, several such modules are connected in series, that is to say, they are passed through in succession by the objects to be dried, it being possible for each dryer module to be operated under different conditions, for example at a different temperature.

The dryer module comprises an insulated dryer housing 2 which exhibits on one side an inlet opening 3, which is capable of being closed by a gate which is not represented, and on the opposite end face an outlet opening 4, which is likewise capable of being closed by a gate which is not represented. The vehicle bodies 1 are conveyed through the dryer module from the inlet opening 3 to the outlet opening 4 with the aid of a conveyor system which is only outlined in FIGS. 2 and 3 and which is provided therein with reference symbol 5. The vehicle bodies 1 are conducted through a dryer tunnel 6 which is portal-shaped in cross-section, as can likewise best be gathered from FIGS. 2 and 3.

The air located in the dryer tunnel 6 can be drawn off to the outside through lateral apertures 7 in the lowest region of the side walls 8 of the dryer tunnel 6, situated below the vehicle bodies 1. The apertures 7 can be opened to a variable degree by means of flap valves 9, so that the flow of air can be adjusted.

The air passing through the apertures 7 arrives in two suction ducts 10 which extend parallel to the conveying direction, and therefore parallel to the longitudinal direction of the dryer tunnel 6, in the vicinity of the side walls 11 of the housing. The suction ducts 10 each conduct the air to a vertical air space 13, which is positioned approximately in the middle of the longitudinal extent of the dryer module and which in the following, for reasons which will become clear later, is called the "heating space", and upwards as far as the upper side 12 of the housing. The air that has arrived at the upper end of the heating spaces 13 is directed downwards somewhat via deflecting spaces 14 into a suction space 15 via inlet apertures 16. The suction space 15 is situated directly above the dryer tunnel 6. Said suction space leads from the inlet apertures 16 parallel to the conveying direction substantially over the entire length of the dryer tunnel 6 (see FIG. 1).

The suction apertures 17 of two blowers 18, which are positioned in the transverse direction of the housing 2 (see FIGS. 2 and 3) approximately in the middle of the housing 2, lead into the upper side of the suction space 15. The outlet apertures of the blowers 18 lead to a pressure space 19 extending substantially horizontally between the upper side of the suction space 15 and the internal surface of the upper side 12 of the housing, which in turn again communicates with four air-directing spaces 20 which, viewed in the conveying direction, extend downwards on both sides of the heating spaces 13 parallel to the side walls 11 of the housing. The air-directing spaces 20 can be accessed on foot via doors 21 (see FIG. 3). The walls of the air-directing spaces 20 pointing towards the middle of the housing 2 exhibit passage apertures 22, in which filters 23 are arranged. Through the passage apertures 22 and the filters 23 located herein, the air enters, from the side, two air-diffusing spaces 24 which border the side walls 8 of the dryer tunnel 6 and which extend substantially over the entire length of the dryer tunnel 6, that is to say, also past the heating spaces 13, as can be gathered in particular from FIG. 6.

A plurality of nozzles 25 are installed in the side walls 8 of the dryer tunnel 6, via which the air-diffusing spaces 24 communicate with the interior space of the dryer tunnel 6.

Into each of the two heating spaces 13 a heating unit 26 is introduced from above which exhibits a piping system in the form of a "double P", as FIG. 8 shows in particular, in which a heating unit 26 of such a type is represented in side view. The designation "double P" becomes explicable if FIG. 8 is turned upside down; the "Janus-head" shape of the double-P piping system then becomes discernible. The middle connecting piece 27 of each heating unit 26 is constructed in the upward direction through an aperture 28 in the upper side 12 of the housing.

As FIG. 9 shows, a high-speed burner 29, of a type which is known from other fields of technology but which has not as yet found application in dryers of the type of interest here, is introduced from above into the connecting piece 27. This high-speed burner 29 has a head 30 which seals the connecting piece 27 in the upward direction and in which a port 31 for the heating gas to be combusted, a port 32 for the combustion air, and an outlet 33 for the combustion gases are provided. The heating gas and the combustion air mix in a mixing chamber 34 which projects, in part, far into the connecting piece 27 and contains an ignition electrode (not visible). The port for the ignition electrode bears reference symbol 35 in FIG. 9.

At the lower outlet 36 of the high-speed burner 29 a stable flame arises which, by reason of its high exit velocity, extends downwards into the region of the branching of the "double P" piping system. In the latter the combustion gases circulate, which then escape through the connecting piece 27. This comes about firstly as a result of free flowing towards the flame in the radially outer region of the connecting piece 27 and then through the annular space 37 between the wall of the connecting piece 27 and the wall of the mixing space 34 of the high-speed burner 29.

The dryer module described above operates as follows:

The air located in the interior space of the dryer tunnel 6, which in normal operation has been heated up to a particular temperature, is drawn, with the aid of the two blowers 18, via the lateral apertures 7 in the side walls 8 of the dryer tunnel 6 and also via the suction ducts 10 into the heating spaces 13, where this air is conducted upwards past the outer surfaces of the heating units 26. In the process, the air takes up heat from the heating units 26, that is to say, it is heated. This heated air enters the suction space 15 via the deflecting spaces 14 from both sides, flows in said suction space from the middle region (referred to the conveying direction) in both directions to the blowers 18. The air aspirated by the blowers 18 is emitted into the pressure space 19 and flows in the latter, in the direction of the two side walls 11 of the housing, to the four air-directing spaces 20. The air-directing spaces 20 conduct the heated air to the passage apertures 22, from which it flows into the two air-diffusing spaces 24. On passing through the windows 22, the air is cleaned by the filters 23.

In the air-diffusing spaces 24 a substantially constant overpressure builds up by interaction between inflowing air and air emerging via the nozzles 25. The currents of hot air that are generated by the nozzles 25 are directed towards various regions of the vehicle body 1 which, during the drying process, is moved through the dryer module with the aid of the conveyor system 5. In this process the vehicle body 1 is dried to a certain degree. After the vehicle bodies have passed through all the modules pertaining to the dryer, drying of the vehicle bodies 1 is concluded.

What is claimed is:

1. A dryer for objects, in particular for vehicle bodies, with a) an insulated housing;

b) a dryer tunnel arranged within the housing, in the side walls of which a plurality of inlets are arranged, via which hot circulating air can be directed towards the objects;

c) at least one suction aperture in the region of the dryer tunnel situated below the objects, via which the circulating air emerges from the dryer tunnel;

d) at least one air space arranged to the side of the dryer tunnel, via which the circulating air is drawn upwards with the aid of a blower;

e) at least one air-diffusing space bordering the side wall of the dryer tunnel, which communicates with the pressure side of the blower and from which the circulating air reaches the space of the dryer tunnel via the nozzles;

f) a piping system located in the interior space of the housing, through which hot primary gases flow and which is in heat-exchange relationship with the circulating air, characterised in that g) the piping system comprising a plurality of pipe sections in direct communication with each other wherein the circulating air vertically flows around the plurality of pipe sections and further wherein the piping system is arranged in substantially vertical orientation in the air space which, as a result, is configured as a heating space (13).

2. Dryer according to claim 1, characterised in that the heating space (13) extends only over a part of the length of the dryer tunnel (6) and communicates with suction ducts (10) which in turn extend over the entire length of the dryer tunnel (6).

3. Dryer according to claim 2, characterised in that, viewed in the longitudinal direction of the dryer tunnel (6), in addition to the heating space (13) at least one air-directing space (20) is provided which is connected via passage apertures (22) to the air-diffusing space (24) bordering the side wall (8) of the dryer tunnel (6).

4. Dryer according to claim 3, characterised in that filters (23) are arranged in the passage apertures (22) of the air-directing space (20).

5. Dryer according to claim 1, characterised in that the upper end of the heating space (13) communicates with a suction space (15) which is arranged directly above the dryer tunnel (6) and into which the suction aperture (17) of the blower (18) leads.

6. Dryer according to claim 5, characterised in that a pressure space (19) which is connected to the pressure side of the blower (18) and which communicates laterally with the air-directing space (20) extends above the suction space (15).

7. Dryer according to claim 1, characterised in that the piping system is arranged in the heating space (13) in a suspended manner.

* * * * *